United States Patent [19]

Okazaki et al.

[11] Patent Number: 4,524,252

[45] Date of Patent: Jun. 18, 1985

[54] MOTOR-DRIVEN ELECTRIC TIMER

[75] Inventors: Tetuji Okazaki; Kanji Kawasaki; Masayoshi Hirose, all of Okayama, Japan

[73] Assignee: Omron Tateisi Electronics Co., Kyoto, Japan

[21] Appl. No.: 435,219

[22] Filed: Oct. 19, 1982

[30] Foreign Application Priority Data

| | | | |
|---|---|---|---|
| Oct. 19, 1981 | [JP] | Japan | 56-166977 |
| Oct. 19, 1981 | [JP] | Japan | 56-155318[U] |
| Oct. 21, 1981 | [JP] | Japan | 56-168341 |

[51] Int. Cl.[3] ..... H01H 7/00

[52] U.S. Cl. ..... 200/38 E; 74/568 T

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 153 P; 74/568 T; 368/101, 106, 112

[56] References Cited

U.S. PATENT DOCUMENTS

| | | | |
|---|---|---|---|
| 2,641,661 | 6/1953 | Puerner et al. | 200/38 E |
| 2,984,716 | 5/1961 | Timm | 200/38 DA |
| 3,031,590 | 4/1962 | Johnson et al. | 200/38 C |
| 3,598,936 | 8/1971 | Saarem et al. | 200/38 R |
| 3,700,837 | 10/1972 | Schulze-Berge | 200/38 R |

*Primary Examiner*—A. D. Pellinen
*Assistant Examiner*—Morris Ginsburg
*Attorney, Agent, or Firm*—Wegner & Bretschneider

[57] ABSTRACT

A motor-driven electric timer consists of a motor, a reduction gear assembly for reducing a rotational speed from the motor to a predetermined speed, an externally actuatable slider having at one side wall thereof a rack, a clutch mechanism consisting of a pinion gear driven by the reduction gear assembly for driving the rack and a spring wire disengageably biasing the pinion gear for engagement with the rack, a switching lever member following a side wall of the slider, a contact member actuated by the switching lever member, and a flat-shaped housing enclosing the timer.

8 Claims, 14 Drawing Figures

MOTOR-DRIVEN ELECTRIC TIMER

BRIEF SUMMARY OF THE INVENTION

This invention relates to a motor-driven electric timer, and more particularly, to an improved timer which is small in size.

There is well known a motor-driven electric timer which includes a time setting mechanism externally manipulated to a desired time position, a rotary circular cam having a recess or notch on a peripheral circle thereof for a rotary movement to an angular position corresponding to the desired time position of the time setting mechanism, a reduction gear assembly driven by an electric motor for rotating the rotary cam through a clutch member, and a switching lever following the rotary cam for actuating a movable contact of a switching contact member, wherein as the time setting mechanism returns to its original position together with the rotary cam, the switching lever at a following finger thereof falls into the recess of the rotary cam so as to reset the switching contact member to its original position. Generally, the switching contact member includes a time contact member for switching a load to be controlled by the timer and a motor contact member for switching an energization of the motor, which are disposed in a stacked-up construction so as to be actuated by the switching lever.

When the conventional motor-driven electric timer is designed to be small in size, however, a desired quick and large stroke motion of the following finger of the above-mentioned switching lever cannot be expected to a satisfactory extent because the rotary circular cam at its diameter is reduced into small size and rotated at a very slow speed, so that the respective contacts are slowly driven back to their original position at a reduced speed so as to be burnt by arc generated between the contacts at breaking position and their mechanical life is reduced. Thus, the conventional motor timer is difficult to be miniaturized. Moreover, the conventional motor timer has the disadvantages that the timer must be assembled with difficult adjustment such that the following finger of the switching lever must precisely come into engagement with the recess of the rotary cam at the initial position of the time setting mechanism and a large member of components must be assembled with expensive assembling work. Generally, the time setting mechanism, the reduction gear assembly, the motor, the rotary cam and/or the switching contact member are constructed in a stacked-up construction, so that the motor timer is difficult to be reduced into small in size, particularly to a reduced height. Such a timer small in size, viz. flat-shaped timer, is desired when it is mounted on a printed circuit board.

It is, therefore, a primary object of this invention to provide a motor-driven timer which is small in size, especially in height.

It is a further object of this invention to provide a motor-driven electric timer which performs a quick movement of a switching contact member with a sufficient stroke to provide a good contact switching operation.

It is a still further object of this invention to provide a motor driven timer which is free from any adjustment work on an initial position of the timer, and is easy to assemble.

According to this invention, there is provided a motor-driven electric timer comprising a slider having a rack in its sliding direction, which is externally actuatable for manually setting the timer to a desired position, a motor, a reduction gear assembly for reducing a rotational speed from said motor to a predetermined speed, a pinion being adapted to be engaged between the reduction gear assembly and the rack of the slider, a switching lever member following the movement of the slider, and a contact member actuated by the switching lever member.

BRIEF DESCRIPTION OF DRAWINGS

Other objects as well as the numerous advantages of the motor-driven electric timer according to this invention will become apparent from the following detailed description and the accompanying drawings in which.

DETAILED DESCRIPTION

Figure 1:
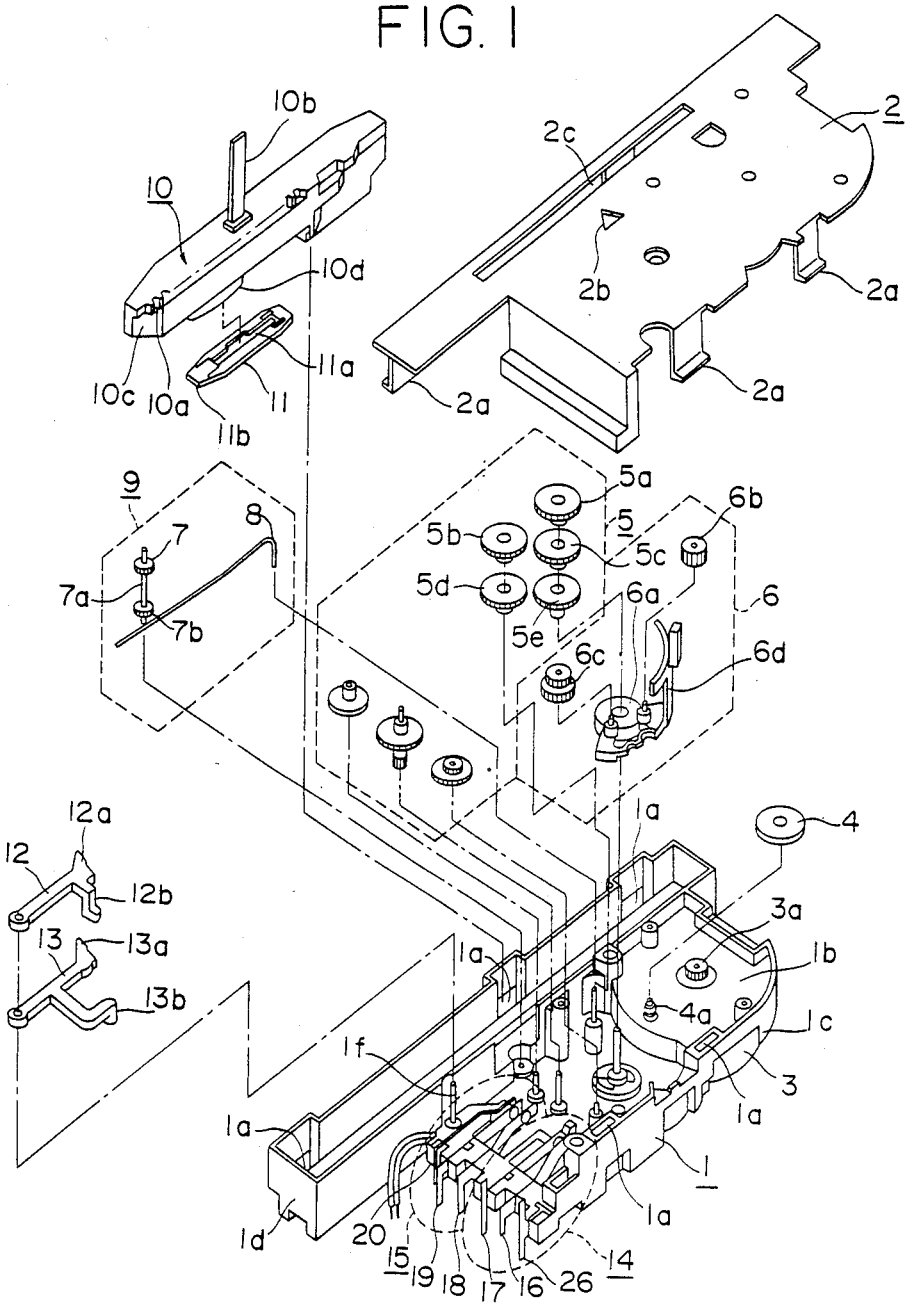
FIG. 1 is a perspective disassembled view showing a motor-driven electric timer as one embodiment of this invention.

Referring, now, to FIG. 1, there is shown a motor-driven electric timer as one embodiment of this invention. The timer includes a housing base 1, a motor or a synchronous motor 3 mounted on the base 1, a reduction gear assembly 5, a gear 4 transferring the rotation from the motor 3 to the gear assembly 5, a frequency selection mechanism 6, a clutch mechanism 9 having a pinion gear 7 and a spring wire 8 for biasing the gear 7, a slider 10, a cam plate 11, switching levers 12 and 13, a motor contact member 14, a time contact member 15, and a cover 2.

The housing base 1 is a molded plastic and includes a box-shaped slide case 1*d*. The cover 2 is mounted on the housing base 1 in such a manner that nails 2*a* extending from the cover 2 are engaged with holes formed on side wall portions of the housing base 1 having the slide case 1*d*. The base 1 includes a motor enclosing portion 1*b* in which the motor 1 of a flat cylindrical shape is installed from the downward of the base 1.

Figure 3:
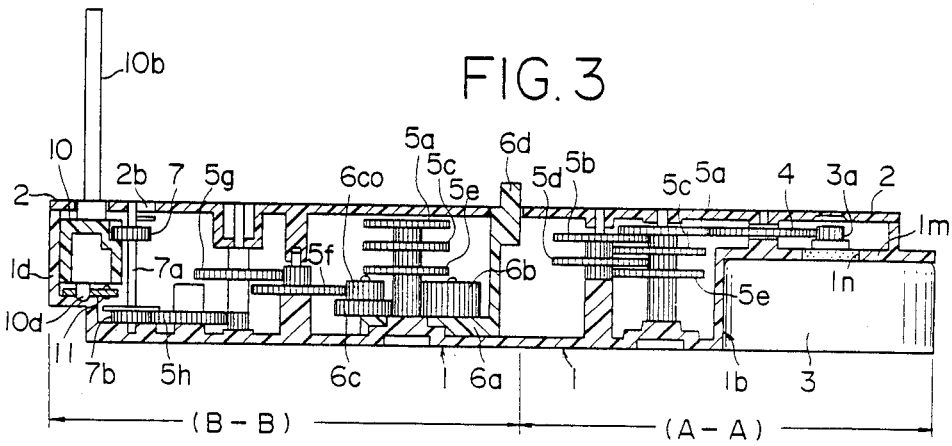
FIG. 3 is a sectional view taken along the lines A—A and B—B of the timer of FIG. 2, which includes the cover.
Figure 4:
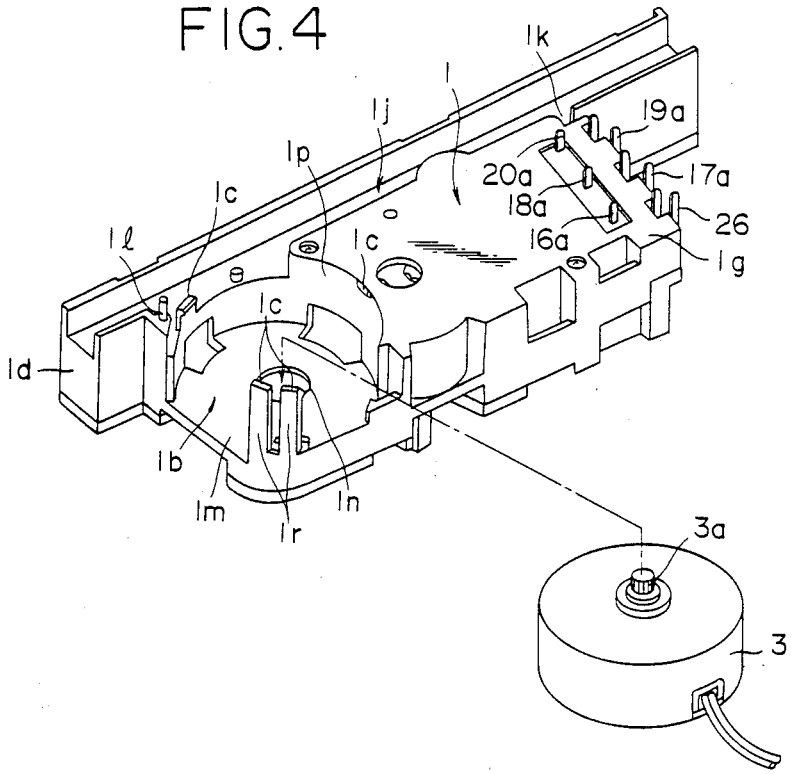
FIG. 4 is a bottom perspective view of the timer of FIG. 2 in which a motor is dismounted from the timer for explanation.

As shown in FIG. 3, the motor enclosing portion 1*b* is a recessed portion of the housing base 1 the depth of which is equal to the height of the body of the motor 3, wherein an upper wall 1*m* of the motor enclosing portion 1*b* has a hole 1*n* for projecting a driving gear 3*a* of the motor 3 therethrough. As illustrated in FIG. 4, at the peripheral of the motor enclosing portion 1*b* there are provided a plurality of nails 1*c* on flexible tabs 1*r* and on a peripheral wall 1*p*, whereby the motor 3 mounted in the portion 1*b* is fastened by the nails 1*c*. Since the motor 3 is installed into the portion 1*b* to be exposed to the external of the base 1, the heat from the motor 3 is sufficiently radiated outwardly of the timer.

Figure 2:
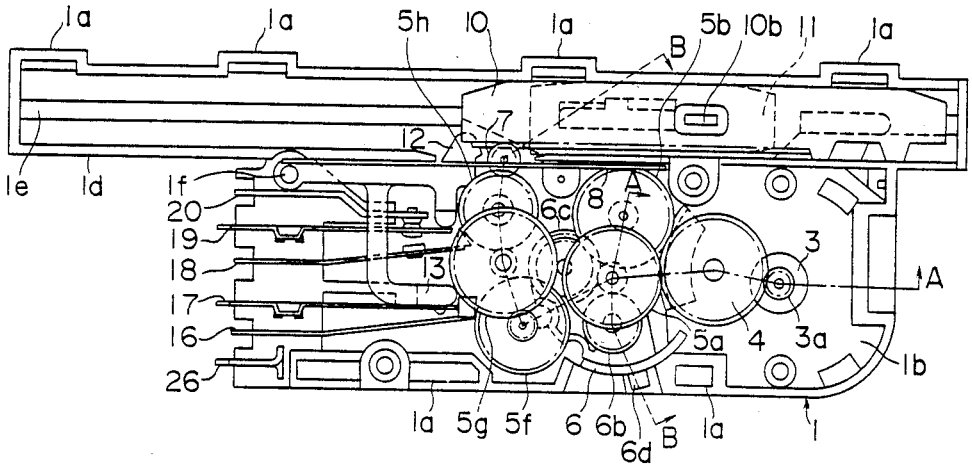
FIG. 2 is a top plan assembled view showing the timer of FIG. 1 with its cover removed.

The gear assembly 5 consists of eight reduction gears 5*a* through 5*h* as illustrated in FIGS. 2 and 3 so as to reduce the rotational speed from the driving gear 3*a* of the motor 3 through the gear 4 to a predetermined speed for application to an input gear 7*b* connected to the pinion gear 7. The reduction gear assembly 5 is so arranged in a side-by-side relationship with the motor enclosing portion 1*b* that the respective reduction gears 5*a* through 5*h* are arranged in parallel with the driving gear 3*a*. The first gear 5*a* as the top gear of the assembly 5 is disposed coplanar with the gear 3*a*, whereby the reduction gear assembly 5 is disposed within the height of the motor 3 and the gear 3*a*. Since the gears 3*a*, 4 and 5*a* rotated at the highest speed are arranged coplanar, they are advantageous to be lubricated with grease so that the gear noise is reduced. The gear 4 is mounted on a shaft 4*a* standing on the base 1 to transfer the rotation from the gear 3*a* to the gear 5*a*.

Figure 5:
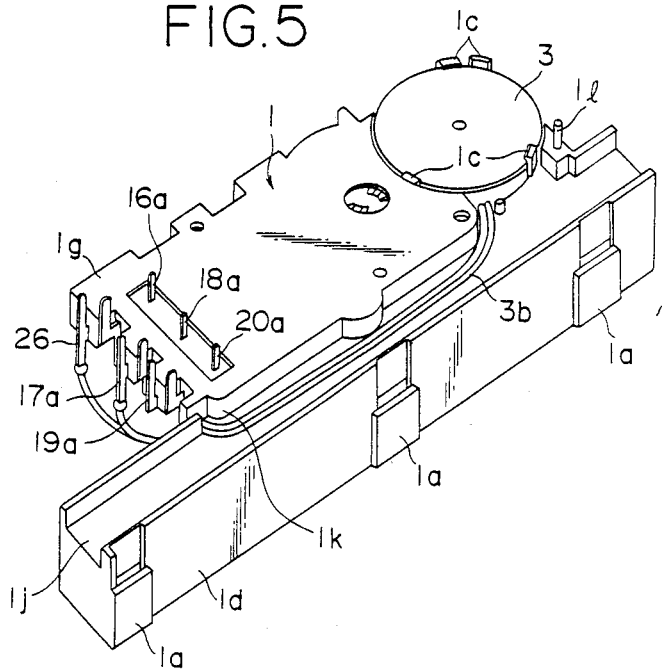
FIG. 5 is a bottom perspective view of the timer of FIG. 2.

As illustrated in FIGS. 4 and 5, on the back surface of the slide case 1*d* there is formed a recess 1*j* through which a pair of wires 3*b* are extended from the motor 3 to terminals 17*a* and 26 for connection therewith. An open area 1*k* is formed on a side wall of the recess 1*j* so as to allow the wires 3*b* to pass therethrough. Thus, the wires 3*b* are prevented from undesirably extending outwardly of the timer, so that the timer can be mounted on a desired place without bothering by the wires. If desired, a nail may be formed in the recess 1*j* so as to ensure the wires 3*b* to be fixedly enclosed within the recess 1*j*.

Returning to FIGS. 1 through 3, the frequency selection mechanism 6 is adapted to be externally actuated by a lever 6*d* in accordance with a frequency of an a.c. power applied to the motor 3. Frequency gears 6*b* and 6*c* are designed for 50 Hz and 60 Hz, respectively, and mounted on a base 6*a* swingable with respect to a shaft of the gears 5*a*, 5*c* and 5*e*. The gear 6*c* has a gear portion 6*co* having a reduced ratio 50/60. Both of the gears 6*b* and 6*c* mesh with the gear 5*e*, but the 5*f* is adapted to mesh with one of the gears 6*b* and 6*c* by the externally actuated lever 6*d*. Thus, the rotational speed from 5*e* is adjusted to a predetermined speed according to the frequency applied to the synchronous motor 3.

Figure 7:
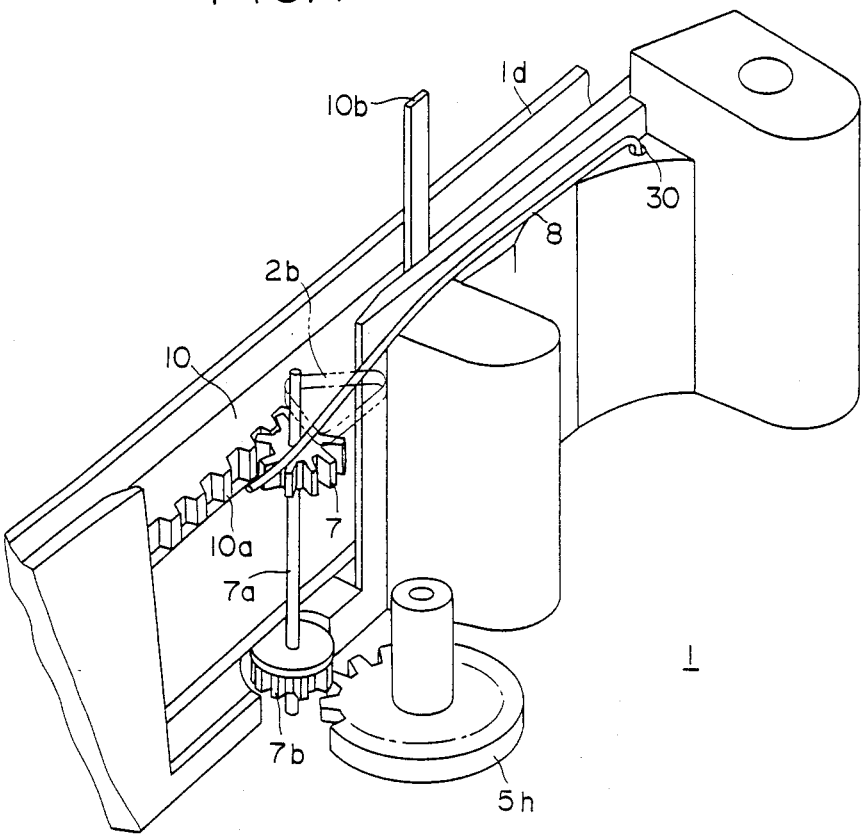
FIG. 7 is a perspective partial view of a clutch mechanism of the timer of FIG. 2.

The clutch mechanism 9 includes the pinion gear 7 in engagement with a rack 10*a* formed on a side wall of the slider 10, and the spring wire 8 biasing the gear 7 toward the rack 10*a*. As shown in FIG. 3, the pinion gear 7 is fixed to the rotatable shaft 7*a* made of a spring wire, and is driven by the output gear 5*h* of the reduction gear assembly 5 through the input gear 7*b* fixed to the shaft 7*a* at its lower portion. As illustrated in detail in FIG. 7, an upper end of the pinion shaft 7*a* is movably supported within a guide window 2*b* formed in the cover 2, and biased by the spring wire 8 toward the rack 10*a*. The spring wire 8 at one end thereof is inserted in a supporting hole 30 formed on the housing base 1. Other end of the wire 8 is supported between the slide case 1*d* and a shaft 1*f* standing on a bottom surface of the base 1. Thus, the wire 8 is supported to bias the shaft 7*a* for engagement with the rack 10*a*, whereby the pinion gear 7 driven by the motor 3 is engaged with the rack 10*a* formed along the slide direction of the slider 10 so as to drive the slider 10 to its original position. When the slider 10 is enforced to move by an external operation through a knob 10*b*, the pinion gear 7 is disengaged from the rack 10*a* by bending the spring shaft 7*a* so as to allow the slider 10 to freely move, wherein the shaft 7*a* is not rotated because of the gear 7*b* meshing with the reduction gear assembly 5 and the movement of the upper end of the shaft 7*a* is limited within the guide window 2*b*.

Returning the FIGS. 1, 2 and 3, the slider 10 is slidably mounted within the slide case 1*d*, and the knob 10*b* is adapted to externally extend through a slit 2*c* formed in the cover 2 for an external operation to set the timer to a desired time or operation position. The slider 10 at its one end has a taper-shaped portion 10*c* so that nails 12*a* and 13*a* of the switch levers 12 and 13 smoothly follow the side wall of the slider 10. On a lower surface of the slider 10 there is provided a projection 10*d* which is adapted to be slidably engaged with a linear groove 1*e* formed on a bottom wall of the slide case 1*d*, whereby the slider 10 is smoothly supported in the slide case 1*d* for a slidable movement.

The cam plate 11 has a hole 11*a* for engagement with the projection 10*d* to provide a play therebetween in a slide direction, and is so disposed between the slider 10 and the slider case 1*d* that the cam plate 11 is freely movable relative to the slider 10 for a predetermined distance and slidably moves within the case 1*d* together with the slider 10.

Figure 6:
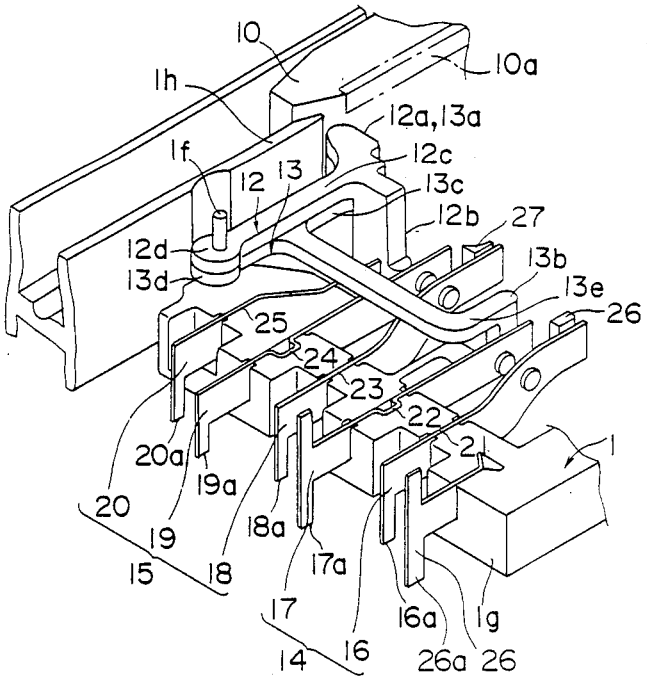
FIG. 6 is a perspective partial view of a contact mechanism section of the timer of FIG. 2.

In FIG. 6, there are shown in detail the motor contact member 14 and the time contact member 15. The motor contact member 14 includes a movable contact blade 17 and a stationary contact blade 16 which are flexible and inserted into slits 22 and 21 formed on a peripheral portion 1*g* of the housing body 1 is parallel with one another. A free end of the stationary contact blade 16 is biased toward the movable contact blade 17 by spring force of the blade 16, and generally comes into contact with a rectangular post 26 standing on the base 1 so as to provide a break circuit therebetween. The time contact member 15 includes a flexible movable contact blade 19, a flexible stationary contact blade 18 and a solid stationary contact blade 20 which are inserted into slits 24, 23 and 25, respectively, formed on the peripheral portion 1*g* in parallel with the slits 21 and 22.

A free end of the stationary contact blade 18 normally comes into contact with a triangle post 27 standing on the base 1 so as to come out of contact with the movable contact blade 19 and provide a break circuit therebetween. The stationary contact blade 20 fixed to the slit 25 normally comes into contact with the movable contact blades 19 to provide a close circuit therebetween. The respective contact blades 16 through 20 have terminal portions 16*a* through 20*a* projecting downwardly of a back wall of the housing base 1, which are adapted to be inserted into holes formed on a printed-circuit board (not shown in drawings) whereby the timer can be mounted on the board with ease.

The terminal portions 16*a*, 18*a* and 20*a* outwardly extend through a back surface of the peripheral portion 1*g*, as illustrated in FIG. 5, so as to ensure an electrical insulation among them. The terminal 26 is inserted in the peripheral portion 1*g* as a motor wiring terminal, and has a downwardly extending projection. In the back surface of the housing base 1 near the motor enclosing portion 1*b*, there is inserted a metal pin 1*l* as illustrated in FIG. 4. When the timer is mounted on a printed-circuit board, the timer is firmly fixed to the board by the pin 1*l* together with the terminals 16*a* to 20*a* and 26 which extend through the board and are soldered.

As illustrated in FIG. 6, the switch levers 12 and 13 have same-size lever portions 12*c* and 13*c*, and ring base portions 12*d* and 13*d* which are rotatably mounted on the shaft 1*f* standing on the base 1, respectively. The lever 12 further includes at its free end a finger 12*a*, and an actuator 12*b* downwardly extending so as to come into contact with the movable contact blade 19. The lever 13 includes at its free end a finger 13*a*. The lever 13 further includes a L-shaped arm 13*e* horizontally extending from a middle portion of the lever portion 13*c*, and an actuator 13*b* downwardly extending from the arm 13*e* so as to come into contact with the movable contact blade 17. Thus, a pair of levers 12 and 13 can actuate the contact members 14 and 15 in a coplanar arrangement fashion, so that the timer can be reduced in height. The lever portions 12*c* and 13*c* are urged into contact with a side wall 1*h* of the slide case 1*d* by the biasing contact blades 19 and 17 so that the fingers 12*a* and 13*a* enter inside the slide case 1*d*, as shown in FIG. 6. FIG. 6 shows initial positions of the slider 10, the levers 12 and 13 and the contact members 14 and 15, wherein the motor contact member 14 is in a break position, and the contact members 19 and 20 make a close circuit.

Figure 8A:
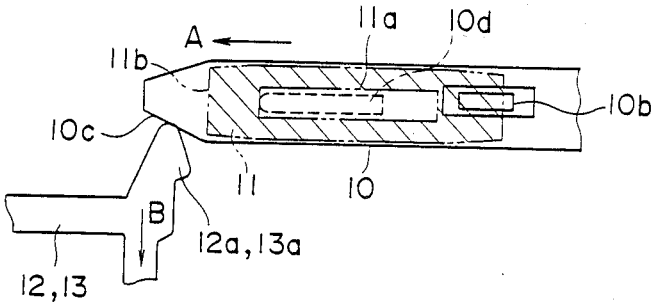
FIGS. 8A through 8C are schematic views for illustrating the movement of a slider of the timer of FIG. 2.

Returning to FIG. 8A, the cam plate or member 11 is engaged with the downward projection 10*d* retaining a play distance. When the slider 10 is moved from its original or initial position to a setting time position in a direction of the arrow mark A, the cam plate 11 at its hole 11*a* is pushed by the projection 10*d* of the slider 10 so as to move together with the slider 10. Then, a front portion 11*b* of the cam plate 11 is behind the taper-shaped portion 10*c*, so that the fingers 12*a* and 13*a* follow the taper-shaped portion 10*c* of the slider 10 at its side wall and the levers 12 and 13 move in a direction of the arrow mark B for pushing the blades 19 and 17 to their set positions. Thus, the timer is set and the motor 3 starts to drive the slider 10 to its original position.

Figure 8B:
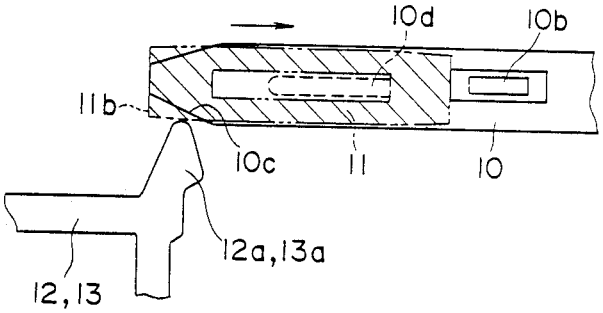

As illustrated in FIG. 8B, when the slider 10 is driven by the pinion gear 7 to move to its original position (a right hand direction of FIG. 8B) after the timer is set, the cam plate 11 is pushed by the projection 10*d* to move together with the slider 10 wherein the front portion 11*b* is aligned with the top portion of the taper-shaped portion 10*c*. Therefore, as the slider 10 comes close to its original position and the fingers 12*a* and 13*a* reach the taper-shaped portion 10*c*, the finger 13*a* is still in contact with a side wall of the cam plate 11 so that the lever 13 is not rotated and the rotation of the lever 12 also is blocked by the engagement between the actuator 12*b* and a side portion of the lever portion 13*c*, wherein the finger 12*a* is out of engagement with the slider 10.

Figure 8C:
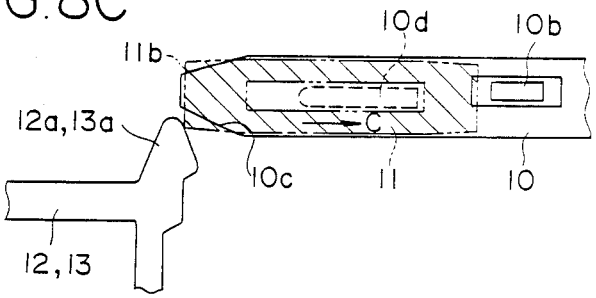

In FIG. 8C, as the slider 10 returns to its original or initial position and the front portion 11*b* of the cam plate 11 reaches the finger 13*a*, the plate 11 is quickly pushed to the direction of arrow mark C by the biased finger 13*a* so that the lever 13 is quickly rotated to its original position. At the same time, the lever 12 also follows the movement of the lever 13 so that it quickly returns to its original position. Thus, the contact members 14 and 15 quickly return to their original positions and the timer is stopped.

The cam plate 11 prevents the switch levers 12 and 13 from gradually returning to their original positions along the taper-shaped portion 10*c* as the slider 10 approaches its original position, and lets the levers 12 and 13 quickly return to their original positions, whereby the respective movable contacts are quickly moved to their original position with a large stroke. Thus, the contact members 14 and 15 avoid from burn by arcs, and enjoy prolonged contact lives.

It will be understood from the foregoing description that the motor-driven electric timer of this embodiment includes the time setting mechanism of a slide type, the switch levers, the contact members, and reduction gear assembly and the motor which are arranged in coplanar, whereby the timer is reduced to small size and a flat shape, and provides an improved contact switching operation. The initial adjustment of the timer is not necessary because the slider has only to be inserted in the slide case and then initial position is affirmed.

Further features of this invention will be explained in accordance with a little modified embodiment illustrated in FIG. 9 and FIGS. 10A to 10C.

Figure 9:
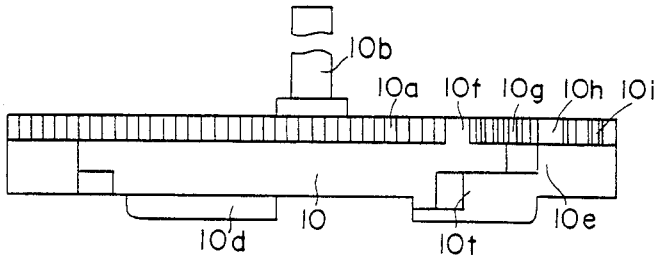
FIG. 9 is a side view of a modified slider of the timer of FIG. 2.
Figure 10A:
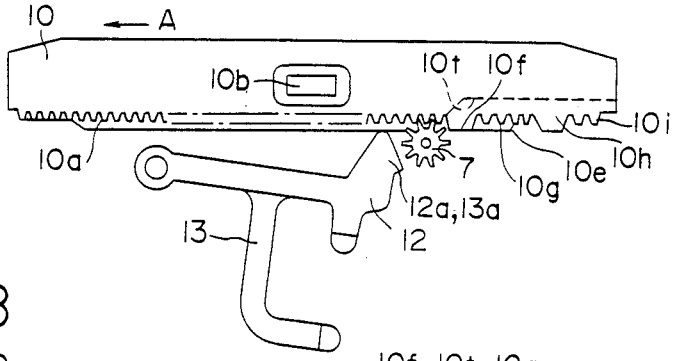
FIGS. 10A through 10C are schematic views for illustrating the movement of the slider of FIG. 9.

On a side wall of a back portion of the slider 10 there are formed a first step 10*t* and a second step 10*e* as shown in FIGS. 9 and 10A. The first step 10*t* consisting of slanting and flat surfaces is formed on a lower position of the slider 10 so as to be followed by the finger 13*a* of the lever 13 for actuating the motor contact member 14. The second step 10*e* consisting of slanting and flat surfaces is formed on an upper position of the slider 10 so as to be followed by the finger 12*a* of the lever 12 for actuating the time contact member 15.

Referring to FIG. 10A, the respective fingers 13*a* and 12*a* are in contact with the side walls of the cam plate 11 and the slider 10, in which the contact members 14 and 15 are actuated. If the slider 10 is further moved by hand in the direction of the arrow mark A in FIG. 10A, the finger 13*a* first comes in contact with the first step 10*t* so as to turn off the motor contact member 14. If the slider 10 is further forwarded, the finger 12*a* comes in contact with the second step 10*e* so as to reset the time contact member 15.

The motor timer at the position of FIG. 10A is set and normally advances its operation toward its original position by driving back the slider 10. As explained in the above-description about FIG. 10A, however, by externally sliding the slider 10 to a further forward position, the motor 3 is deenergized, so that the slider 10 is not driven by the motor 3 and the time contact member 15 remains in a set position, vis. in a continuous operation of a load wired to the time contact member 15. By further forwarding the slider 10, the time contact member 15 also is reset.

Figure 10B:
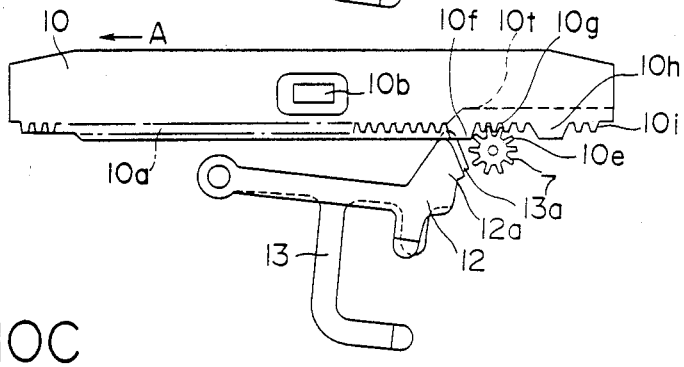
Figure 10C:
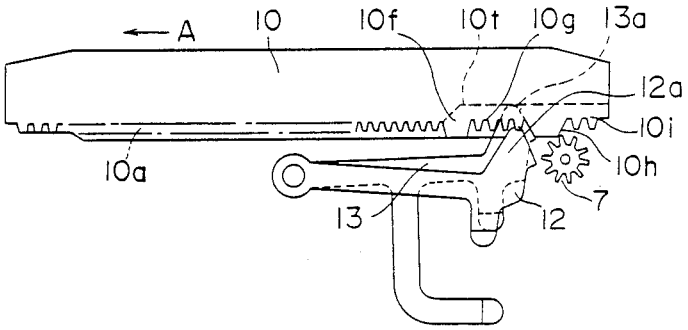

On the extended line of the rack 10*a* in an upper position of the slider 10, there are disposed a series of a flat projecting portion 10*f*, a first gear-shaped recess 10*g* for engagement with the pinion 7 in the position of FIG. 10B, a flat projection portion 10*h*, and a second gear-shaped recess 10*i*. The recess 10*g* and 10*i* and the steps 10*t* and 10*e* are so arranged that the pinion 7 comes into contact with the first recess 10*g* just before the finger 13*a* falls into the step 10*t* as illustrated in FIG. 10B, the pinion 7 rides on the flat portion 10*h* before the finger 12*a* falls into contact with the recess 10*e* as illustrated in FIG. 10*c*, and the pinion 7 rapidly falls into the recess 10*i* just before the finger 12*a* falls into the step 10*e*.

The above-mentioned operations may be performed by the timer of FIG. 1 because the slider 10 has a similar configuration, but the recesses 10*g* and 10*i* in this embodiment are formed in the form of a rack gear whereby the slider 10 is prevented from being rattled because the pinion 7 is not driven by the motor 3 and meshes with the recess 10*g* or 10*i*.

Thus, when the motor or time contact member is switched to its original position, the pinion 7 biased to the slider 10 comes into contact with the recess 10*g* or 10*i*, providing a snap action with click. Therefore, the timer provides a good operation touch to a continuous operation mode or reset mode. Since the reset position (10*i*), viz., both contact members 14 and 15 are reset, is arranged next to the position (10*g*) where only the motor contact member 14 is reset, the slider 10 is not needed to be moved back to its initial position (FIG. 8C) when the operation mode is changed from the continuous operation position (10*g*) to all reset position, and unnecessary operation of the slider 10 may be reduced.

While this invention has been shown in one form, it will be obvious to those skilled in the art that it is not so limited, but is susceptible of various other changes and modifications without departing from the spirit thereof.

What is claimed is:

1. A motor-driven electric timer comprising a slider having a rack in its sliding direction, which is externally actuatable for manually setting the timer to a desired position, a motor, a reduction gear assembly for reducing a rotational speed from said motor to a predetermined speed, a pinion being adapted to be engaged between said reduction gear assembly and said rack of said slider, a switching lever member following the movement of said slider, and a contact member actuated by said switching lever member.

2. A timer according to claim 1 wherein said motor and said reduction gear assembly are arranged in a side-by-side relationship.

3. A timer according to claim 1 wherein said motor, said reduction gear assembly, said slider and said contact member are arranged in a coplanar relationship.

4. A timer according to claim 1 further comprising a biasing member for biasing said pinion toward said rack for engagement therewith so as to constitute a clutch mechanism.

5. A timer according to claim 1 further comprising a cam plate member mounted on a surface of said slider for a relative movement for a predetermined distance, which is adapted to be followed by said switching lever member and moved by said slider together therewith.

6. A timer according to claim 5, wherein said contact member comprises a time contact switch and a motor contact switch, and said switching lever member consists of a first switching lever adapted to be in contact with said cam plate for actuating said motor contact switch and a second switching lever adapted to be in contact with a side wall of said slider for actuating said time contact switch.

7. A timer according to claim 6, wherein said slider at one side wall surface includes first and second recessed steps to be followed by said first and said second switching levers so that selected one of said first and said second switching levers is urged to be moved back to its original position where said slider is forwarded to a position beyond the maximum setting time position of the timer.

8. A timer according to claim 1 which further comprises a flat-box-shaped housing comprising of a housing base and a cover, said housing base having a motor enclosing portion in which said motor is mounted.

* * * * *